United States Patent [19]

Mackey

[11] 4,094,750

[45] June 13, 1978

[54] CATHODIC DEPOSITION OF OXIDE COATINGS

[75] Inventor: Jack D. Mackey, El Segundo, Calif.

[73] Assignee: Northrop Corporation, Los Angeles, Calif.

[21] Appl. No.: 839,581

[22] Filed: Oct. 5, 1977

[51] Int. Cl.[2] ..... C25D 9/12

[52] U.S. Cl. ..... 204/56 R; 204/56 M

[58] Field of Search ..... 204/56 R, 56 M

[56] References Cited

U.S. PATENT DOCUMENTS

| | | | |
|---|---|---|---|
| 2,275,223 | 10/1936 | Hardoen | 204/56 |
| 2,733,199 | 1/1958 | Wick | 204/56 |
| 2,825,682 | 3/1958 | Missel et al. | 204/38 |
| 3,446,717 | 5/1969 | Farquhar | 204/58 |
| 3,507,699 | 4/1970 | Pell et al. | 204/2.1 |
| 3,574,069 | 4/1971 | Roberts et al. | 204/29 |
| 3,640,778 | 2/1972 | Winfree et al. | 148/6 |
| 3,959,091 | 5/1976 | Moji et al. | 204/38 A |
| 4,007,099 | 2/1977 | Wu | 204/140 |

*Primary Examiner*—R. L. Andrews

*Attorney, Agent, or Firm*—Willard M. Graham; William W. Rundle

[57] ABSTRACT

A process for depositing an oxide layer on a titanium surface in preparation for adhesive bonding, the oxide layer being cathodically deposited in a solution containing isoproponol and a metal salt.

6 Claims, No Drawings

CATHODIC DEPOSITION OF OXIDE COATINGS

BACKGROUND OF THE INVENTION

The importance of titanium, in the manufacture of air frame and space-craft structures, for example, because of its superior heat resistance, high strength, and relatively light-weight, is now well established. Along with the use of titanium in sheet form, forgings, and stampings, titanium is a promising candidate for wide use in high-strength, lightweight laminated structures and composite assemblies fabricated by weld-bonding, diffusion bonding, and adhesive bonding.

It is also well recognized in the metal processing field that it is difficult to bond titanium to other materials, as in sandwich or composite structures, because organic adhesives do not bond well to titanium. Thus a number of special processes for preparing the surface of titanium for adhesive bonding heretofore have been proposed, which processes, however, tend to be relatively complex, time-consuming, and expensive. Time and expense are important considerations, and especially so in the mass production of aircraft, spacecraft, and automobiles, for example.

DESCRIPTION OF THE PRIOR ART

The following patents are cited herein as the most pertinent prior art of which the applicant is aware:

| Number | Name | Date |
|---|---|---|
| Group I | | |
| 2,275,223 | Hardoen | Mar. 1942 |
| 2,733,199 | Wick | Jan. 1956 |
| 3,446,717 | Farquhar et al | May 1969 |
| 3,574,069 | Roberts | Apr. 1971 |
| 4.007,099 | Wu | Feb. 1977 |
| Group II | | |
| 2,825,682 | Missel et al | Mar. 1958 |
| 3,640,778 | Winfree et al | Feb. 1972 |
| 3,959,091 | Moji et al | May 1976 |
| 3,989,876 | Moji et al | Nov. 1976 |

The Group I patents all relate to the cathodic coating of metal surfaces. For example U.S. Pat. No. 2,275,223 (Hardoen) discloses the application of an artificial magnetite coating onto iron or steel by suspending the iron or steel in an electrolytic solution as the cathode.

Wick (U.S. Pat. No. 2,733,199) teaches the cathodic deposition of a hydrated oxide of chromium on a metal surface such as iron, steel, or zinc.

Farquhar et al (U.S. Pat. No. 3,446,717) discloses the cathodic treatment of metals to form a protective chromate coating thereon.

U.S. Pat. No. 3,574,066 (Roberts et al) discloses a process for cathodically depositing a thin film of chromium on a steel strip.

Wu (U.S. Pat. No. 4,007,099) discloses a method for the cathodic production of micropores on a decorative metal plate wherein the metal base to be treated is used as the cathode.

The Group II patents all relate to processes for coating titanium.

Missel et al (U.S. Pat. No. 2,825,682) for example, discloses a process for coating the surfaces of titanium base alloys containing about 5% chromium and about 3% aluminum with a metallic film as a preparatory step for subsequent electroplating.

Winfree et al (U.S. Pat. No. 3,640,778) teaches a process for providing titanium alloys with a chemically bonded high-temperature resistant coating, which coating subsequently requires heat treatment at a temperature of from 650°-950° F.

U.S. Pat. Nos. 3,959,091 and 3,989,876, both of Moji et al, relate to a process and article, respectively, in which porous, adhesion-promoting oxide coatings are produced on titanium by anodizing in an aqueous solution containing fluoride ions and one or more oxidizing electrolytes at current densities ranging from 0.25 to 5 amp./ft$^2$.

While it is possible that more pertinent art exists, the applicant's search is believed to have been conducted with conscientious effort to locate and evaluate the most pertinent prior art available at the time, but the above prior art statement is not to be construed as a representation that no better prior art exists.

In view of the prior art, it is an object of my present invention to provide a process for depositing a durable, tenaceous oxide coating on titanium, which coating is ideally suitable for adhesive bonding.

It is further object of my invention to provide a simple, inexpensive, and rapid process for depositing a durable, tenaceous oxide coating on the surface of titanium or titanium alloys.

Other objects and advantages gained with my invention will be readily seen by those skilled in the metal processing arts.

SUMMARY OF THE INVENTION

A durable, tenaceous oxide layer is deposited on the surface of titanium or titanium alloys by suspending the titanium or titanium alloy part, to be processed, as the cathode in a solution containing isoproponol and a metal salt selected from the group including aluminum nitrate, nickelous nitrate, cobalt nitrate, and cupric nitrate, and electrolyzing said part at current densities ranging from 0.02 amp./in.$^2$ to 0.5 amp./in.$^2$, for processing times ranging from 5 to 60 seconds.

DETAILED DESCRIPTION OF THE PREFERRED EMBODIMENTS

Although the primary object of my invention is to provide a rapid, inexpensive process for depositing oxide coatings on titanium and titanium alloys, I have discovered that my process also can be carried out with surprisingly good results on aluminum and aluminum alloys, stainless steel, AZ 31 magnesium, and graphite composites.

One particular advantage in the process of my invention is that satisfactory oxide coatings are deposited very rapidly. Normal processing times can be reduced to 5 to 20 seconds at ambient temperature, although any temperature up to the boiling point of the solvent can be used. Longer processing times will of course produce coatings of greater thickness.

As will be adduced in the following examples, varying concentrations of the metal salt can be employed. Although all of the examples employ a solution composed of a metal salt dissolved in isoproponol, I have found that any of the metal salts dissolved in an aqueous solution will produce a satisfactory oxide coating, although, as taught in the examples, I have used isoproponol as the preferred solvent.

The oxide layer produced by the process of my invention exhibits a number of features of particular importance in the mass production of laminates and composite structures which are finding a much higher rate of application in aircraft, spacecraft, and automobiles. Among the more promising advantages are lower processing times hence lower costs, and the relatively superiority of the oxide layer due to its tenaceous character, compatibility i.e., chemical neutrality, with other materials including adhesives. Generally, oxides of titanium tend to be unstable; aluminum oxides, on the other hand, are not. Other oxides, such as those produced by cobalt nitrate, cupric nitrate, nickelous nitrate also are found to be compatible with other metals and adhesives.

In view of the advantage cited above, the process of my invention should be equally applicable to weld bonding wherein satisfactory spot welds that penetrate through the oxide and adhesive layers are required.

The following are examples carrying out the process of my invention for depositing an oxide coating or layer on the surface of a metal part.

EXAMPLE I

Specimens of Ti.6Al.-4V. alloy were pre-processed by (1) degreasing the specimens in methyl ethyl ketone, (2) cleaning the specimens in a 10% solution of hydrofluoric acid, (3) rinsing the specimens in water, and (4) finally drying the part. The specimens were than suspended as the cathode in a solution containing 8 grams of aluminum per liter of isoproponol and electrolyzed at a current density of 0.07 amp./in.$^2$ for 10–15 seconds. The resultant oxide layers produced by this process were porous and uniform with a thickness ranging from 700–1000 A.

EXAMPLE II

A Ti.Al.-4V specimen was preprocessed by the steps (1)-(4) described in Example I. The specimen was then suspended as the cathode in a solution of 20 grams of cupric nitrate per liter of isoproponol and electrolyzed at a current density of 0.1 amp./in.$^2$ for 30 seconds. A SEM microphotograph showed the resultant copper oxide layer to be approximately 1500A in thickness.

EXAMPLE III

A Ti.Al.-4V. specimen was preprocessed by the steps (1)-(4) described in Example I, and subsequently suspended as the cathode in a solution containing 20 grams of cobalt nitrate per liter of isoproponol, and electrolyzed at a current density of 0.1 amp./in.$^2$ for 30 seconds. An SEM microphotograph showed the resultant cobalt oxide layer to be approximately 1100A in thickness.

EXAMPLE IV

A Ti.Al.-4V. specimen was preprocessed with steps (1)-(4) described in the previous Examples, and suspended in a solution containing 20 grams of nickelous nitrate per liter isoproponol, and electrolyzed at a current density of 0.1 amp./in.$^2$ for 30 seconds. A SEM microphotograph showed the resultant layer of nickel oxide to be approximately 1600A in thickness.

EXAMPLE V

Specimens of AZ magnesium alloy were preprocessed with the steps (1)-(4) described in the previous Example, and subsequently suspended as the cathode in a solution containing 25 grams per liter of isoproponol and electrolyzed at a current density of 0.5 amp./in.$^2$ for 5 seconds. The specimens exhibited improved corrosion resistance in a salt spray environment.

EXAMPLE VI

Specimens of 7075 aluminum alloy were preprocessed by (1) vapor degreasing, (2) alkaline cleaning, (3) rinsing, (4) deoxidizing, (5) rinsing, and (6) drying. Subsequently the specimens were suspended as the cathode in a solution containing 0.3 gram of aluminum per liter of isoproponol, and electrolyzed at a current density of 0.02 amp./in.$^2$ for 45 and 60 seconds.

The specimens were sprayed with BR 127 adhesive primer. BR 127 is a proprietary product of 3 M Company and bonded with FM 73 adhesive. FM 73 also is a proprietary product of 3 M Company. Table I shows the results of lap shear tests with the Boeing phosphoric anodize and the FPL pretreatments as controls.

EXAMPLE VII

Ti.Al-4V. alloy wedge test specimens were preprocessed using steps (1)-(4) described in Example I.

The specimens were then suspended as the cathode in a solution containing 25 grams of aluminum nitrate per liter of isoproponol and electrolyzed at a current density of 0.4 amp./in.$^2$. The specimens were then bonded with FM 400 adhesive, both unprimed and primed with BR 400 adhesive primer. FM 400 is a proprietary product of 3 M Company and BR 400 is a proprietary product of 3 M Company. Table II shows the average crack growths observed when the bonded specimens were exposed to 120° F condensing humidity with the modified phosphate fluoride etch as a control.

EXAMPLE VIII

Titanium 6Al.4V. lap shear specimens were preprocessed in accordance with steps (1)-(4) described in Example I, and the suspended as the cathodes in a solution containing 2 grams of aluminum nitrate per liter of isoproponol, and electrolyzed at a current density of .15 amp./in.$^2$ for times of 30, 45, and 60 seconds.

The specimens were then sprayed with BR 127 adhesive primer and bonded with FM 300k adhesive. BR 127 is a proprietary product of 3 M Company and FM 300k is a proprietary product of 3 M Company. Table III shows the results of the lap shear tests using the Turco 5578 process as a control.

EXAMPLE IX

Specimens of AM 355 stainless steel were vapor degreased and alkaline cleaned, and the suspended as cathodes in a solution containing 2 grams of aluminum nitrate per liter of isoproponol, and electrolyzed for times of 30, 45, and 60 seconds at a current density of .10 amp./in.$^2$.

The parts were then sprayed with BR 127 adhesive primer and bonded with FM 300k adhesive. Table IV shows the results of the T-peel tests. Turco 5578 control was used.

EXAMPLE X

The surfaces of a specimen of epoxy-graphite composite was abraded with sandpaper and cleaned with methyl ethyl ketone. The specimen was then suspended as the cathode in a solution containing 25 grams of aluminum nitrate per liter of isoproponol and electrolyzed at a current density of 0.3 amp./in.$^2$ for 10 seconds. A tenaceous coating of oxide approximately 1000A in thickness was observed on the surface of the specimen.

Table I

| Standard Lap Shear Values for 7075-T6 Aluminum Alloy | | | |
|---|---|---|---|
| Process | Process time | Ultimate strength PSI | Mode of failure % Cohesive |
| Cathodic Oxide | 45 sec. | 5675 | 100 |
| Cathodic Oxide | 60 sec. | 5710 | 100 |
| FPL Etch (control) | 12 min. | 5420 | 100 |
| Phosphoric Anodize (control) | 30 min. | 5290 | 100 |

Table II

| Wedge Test Results for 6Al, 4V Titanium Alloy | | | | | |
|---|---|---|---|---|---|
| | | Unprimed | | | |
| Process | Process time seconds | Average Crack Growth (inches) 1 hr. | 24 hr. | 72 hr. | Failure mode % cohesive |
| Cathodic Oxide | 10 | 0.11 | 0.22 | 0.27 | 95–100 |
| Cathodic Oxide | 15 | 0.21 | 0.23 | 0.33 | 95–100 |
| Phosphate-Fluoride | | 0.25 | 1.2 | | 10–20 |
| | | BR400 Primed | | | |
| Cathodic Oxide | 10 | 0.27 | 0.30 | 0.38 | 90–100 |
| Cathodic Oxide | 15 | 0.27 | 0.30 | 0.39 | 90–100 |
| Phosphate-Fluoride | | 0.25 | 1.1 | | 10–20 |

Table III

| Standard Lap-Shear Values for 6A1 4V Titanium Alloy | | | |
|---|---|---|---|
| Process | Process time | Ultimate strength PSI | Mode of failure % Cohesive |
| Cathodic Oxide | 30 sec. | 5950 | 100 |
| Cathodic Oxide | 45 sec. | 5685 | 100 |
| Cathodic Oxide | 60 sec. | 5750 | 100 |
| Turco 5578 control | 5 min. | 6650 | 100 |

Table III-continued

| Standard Lap-Shear Values for 6A1 4V Titanium Alloy | | | |
|---|---|---|---|
| Process | Process time | Ultimate strength PSI | Mode of failure % Cohesive |
| control | 5 min. | 6650 | 100 |

Table IV

| T-Peel Test Values for AM355 Stainless Steel | | | |
|---|---|---|---|
| Process | Process time | peel values (inch pounds) | Mode of failure % Cohesive |
| Cathodic Oxide | 30 sec. | 12.5 | 60 |
| Cathodic Oxide | 45 sec. | 14.5 | 70 |
| Cathodic Oxide | 60 sec. | 10.7 | 30 |
| Turco 5578 control | 5 min. | 15.0 | 70 |

I claim:

1. A process for depositing a tenaceous, adhesion-promoting oxide coating on the surface of a metal part, comprising: cleaning the surfaces of said part, suspending said part as the cathode in a solution containing isoproponol and a metal salt selected from the group consisting essentially of aluminum nitrate, cupric nitrate, cobalt nitrate, and nickelous nitrate, electrolyzing said part at a current density ranging from 0.02 to 0.5 amp./in.$^2$ for times ranging from 5–60 seconds.

2. The process in accordance with claim 1 wherein said metal part is titanium.

3. The process in accordance with claim 1 wherein said metal part is magnesium.

4. The process in accordance with claim 1 wherein said part is aluminum.

5. The process in accordance with claim 1 wherein said part is stainless steel.

6. A process for depositing a tenaceous adhesion-promoting oxide coating on the surface of a graphite-epoxy part, comprising: cleaning the surfaces of said part, suspending said part as the cathode in a solution containing isoproponol and a metal salt selected from the group consisting essentially of aluminum nitrate, cupric nitrate, cobalt nitrate, and nickelous nitrate, and electrolyzing said part at a current density of 0.1 amp./in.$^2$ for 30 seconds.

* * * * *